US005086542A

United States Patent [19]

Franklin et al.

[11] Patent Number: 5,086,542

[45] Date of Patent: Feb. 11, 1992

[54] ELECTRONIC STOP MOTION FOR TEXTILE DRAW FRAME

[76] Inventors: James R. Franklin, P.O. Box 82, Bessemer City, N.C.; Larry R. Wright, Rte. 3, Box 40, Kings Mountain, N.C.

[21] Appl. No.: 621,051

[22] Filed: Nov. 30, 1990

[51] Int. Cl.[5] ..... D01G 31/00; D01H 13/16

[52] U.S. Cl. ..... 19/0.25; 57/81

[58] Field of Search ..... 19/0.2, 0.22, 0.25, 19/150, 157, 159 R, 159 A; 226/11, 196; 340/677; 28/187, 242; 57/80–86; 200/61.18; 66/163; 242/37 R, 148, 157 R

[56] References Cited

U.S. PATENT DOCUMENTS

| | | | |
|---|---|---|---|
| 3,266,692 | 8/1966 | Whitten | 19/157 X |
| 3,434,274 | 3/1969 | Doll | 19/0.2 |
| 3,811,261 | 5/1974 | Felix | 57/81 |
| 3,911,969 | 10/1975 | Rydborn | 139/370 |
| 3,916,687 | 11/1975 | Loepfe et al. | 28/187 X |
| 4,072,935 | 2/1978 | Rydborn | 340/259 |
| 4,095,062 | 6/1978 | Savageau | 57/81 X |
| 4,202,506 | 5/1980 | Rohner | 242/37 R X |
| 4,267,554 | 5/1981 | Loepfe et al. | 340/677 |
| 4,300,342 | 11/1981 | Highsmith | 57/81 |
| 4,311,958 | 1/1982 | Aeppli | 340/677 X |
| 4,455,549 | 6/1984 | Rydborn | 340/517 |
| 4,512,028 | 4/1985 | Stutz | 377/16 |
| 4,695,830 | 9/1987 | Graham | 340/677 |
| 4,768,026 | 8/1988 | Makino | 340/677 |
| 4,881,062 | 11/1989 | Makino et al. | 340/677 |
| 4,914,785 | 4/1990 | Hauner et al. | 19/0.25 |

FOREIGN PATENT DOCUMENTS

| | | | |
|---|---|---|---|
| 3637969 | 5/1988 | Fed. Rep. of Germany | 57/80 |
| 1026408 | 10/1953 | France | 19/0.25 |
| 1093315 | 3/1966 | United Kingdom | 340/677 |
| 2092187 | 8/1982 | United Kingdom | 19/0.25 |

OTHER PUBLICATIONS

Stuber Brochure, Otto Stuber GmbH & Co KG, West Germany.

*Primary Examiner*—Werner H. Schroeder
*Assistant Examiner*—Ismael Izaguirre
*Attorney, Agent, or Firm*—Bell, Seltzer, Park & Gibson

[57] ABSTRACT

An apparatus for sensing a parting in any of the strands of sliver fed from a creel to the drafting rolls of a high speed textile draw frame to stop the drawing process in response to a sliver parting. A plurality of sliver guides are mounted on an elongate arm which is compact and readily mounted on the creel. The sliver guides are U-shaped with inturned upper end portions defining a restricted opening at the top portion and a capacitive sensing switch positioned in the bight portion thereof. The sliver guides also include a low coefficient of friction coating to reduce the accumulation of lint. Cylindrical post separators are positioned alongside the path of the slivers to maintain separation and prevent entangling of adjacent slivers. Logic and control electronics are contained within a housing carried by the elongate arm.

13 Claims, 3 Drawing Sheets

ELECTRONIC STOP MOTION FOR TEXTILE DRAW FRAME

FIELD OF THE INVENTION

This invention relates to an apparatus for detecting the parting of a strand of sliver during textile processing and stopping the textile processing operation in response thereto, and more particularly, to an electronic stop motion for use with a creel feeding a textile draw frame.

BACKGROUND OF THE INVENTION

It is common in the textile material processing industry to provide sensors which can detect irregularities in the textile feedstock during processing. These sensors are combined with an interface to the drive motor power supply or clutch to create a "stop motion" which stops the processing operation in response to the detected irregularity. For example, the high speed textile drawing process takes a feed of multiple strands of slivers composed of textile fibers and produces a single drawn sliver. It is important for the quality of the drawn sliver that the input feed slivers do not part during the drawing operation, or if so, that the drawing operation be immediately stopped until the parted sliver can be pieced together. Although the sliver may be quickly and easily pieced together by hand, a continuous monitoring system is desirable to detect sliver parting and to concurrently stop the drawing process.

A powered creel is often used in conjunction with the high speed draw frame to provide an uninterrupted supply of the sliver stock to the draw frame and to eliminate or reduce stretching of the individual slivers being fed. The powered creel uses a series of driven rollers to move slivers from a series of storage cans to the drafting rolls of the draw frame. Although the powered creel reduces the possibility of sliver parting, quality control considerations still require that the sliver stock fed into the drafting zone of a high speed draw frame be continuously monitored to detect any parting of the sliver which would affect the drawn fiber weight and also the blend if different types of sliver are being processed.

A conventional stop motion for detecting the parting of sliver may typically be a set of two electrically conductive rollers through which the sliver passes. When the sliver parts, leaving no sliver to separate the rollers, an electrical circuit is completed and the drawing process is stopped. One of the disadvantages of this type of detector is that fiber lint and residue from the slivers have a tendency to accumulate upon the moving rollers and prevent the completion of the electrical connection. The drawing process continues despite the absence of one of the feed slivers, thereby producing a lightweight sliver. Other alternative detectors, including switches and photoelectric sensors, may also be rendered inoperable by the accumulation of fiber lint and residue material.

A further disadvantage of some conventional stop motions for sliver, is that they must necessarily contact the sliver and impose a drag upon the sliver to sense a parting. Unfortunately, this drag results in the unwanted effect of increasing the likelihood and frequency of sliver parting.

Mechanical switch stop motions which rely on electrical contact between mechanical components, may be unable to detect a parting of the sliver in the portion of the sliver path between the stop motion and the draw frame. A parting in this portion of the sliver path will cause the sliver in the switch to stop moving; however, electrical contact is not established to trigger the stop motion because the sliver still separates the two mechanical components of the switch. A mechanical switch may only be effective where the parting occurs between the sliver storage cans and the stop motion.

In a related textile field of yarn creeling, capacitive sensing stop motion devices have been developed to detect when a yarn end is down. Textile yarns carry an electrostatic charge, caused by unwinding the yarn from the supply package in the creel and by friction with yarn guides. Similarly, U.S. Pat. No. 4,914,785 to Hauner discloses a single sliver guide with a capacitive sensor held therein by a casting compound with each single sensor located immediately proximate a single sliver storage can.

SUMMARY OF THE INVENTION

It is therefore an object of the present invention to provide a sensitive and reliable stop motion to detect the parting of slivers delivered from a creel to a high speed draw frame.

It is another object of the present invention to provide a stop motion which senses a plurality of slivers, yet which is compact and is readily secured on the creel.

It is yet another object of the present invention to detect a non-moving sliver caused by the parting of sliver in a sliver path between the stop motion sensor and the drafting rolls of the draw frame.

It is a further object of the invention to provide a sliver guide which has a low coefficient of friction surface and which effectively shields an adjacent sliver to prevent a false parting indication.

It is yet a further object of the invention to provide a compact mounting arm for the sliver guides which includes a hollow channel for wiring to electronic logic and control components.

These and other objects and advantages are achieved by the provision of an electronic stop motion according to the present invention associated with a creel feeding slivers to a high speed textile draw frame. The stop motion includes an elongate arm upon which sliver guides and electronic logic and control components may be conveniently mounted. The elongate arm carries a plurality of sliver guides mounted on the arm in side-by-side relation. For a dual delivery draw frame, groups of eight to ten sliver guides may be mounted on a right and left elongate arm. The electronic stop motion of the present invention may be readily and easily installed at a single location on the center beam of the creel.

The sliver guides desirably have a low coefficient of friction coating on the surfaces which contact the moving sliver to reduce the accumulation of textile lint and residue thereon. Preferably, the sliver guides are substantially U-shaped in cross-section with a restricted opening in the upper end to aid in the retention of a sliver. A capacitive switch for sensing the parted sliver is positioned in the bight portion of the sliver guide and preferably has an exposed upper surface flush with the surrounding bight portion of the sliver guide.

A series of cylindrical posts are carried by the elongate arm and positioned to separate sliver passing through adjacent sliver guides. The separating posts prevent the entanglement of slivers in the vicinity of the sliver guides. The separating posts preferably have a polished outer surface which yields a low coefficient of friction surface that the sliver may contact to thereby reduce the accumulation of lint and to lessen the drag that might otherwise be applied to the moving slivers.

The stop motion includes electronic components connected to the capacitive switch sensors for detecting the absence of a parted sliver in a particular sliver guide and also for detecting the absence of movement of the parted sliver in a sliver guide. Therefore, the stop motion according to the present invention may also detect a parting of the sliver in the sliver path after the stop motion, that is, in the area immediately behind the drafting zone. The stop motion also includes electronic components for performing other logic and interface functions. For example, the stop motion includes an initialization circuit for sensing the start up of the draw frame and delaying the unwanted stopping of the draw frame until the slivers are moving at the desired operating speed. This time interval may be preselected by the user to ensure compatibility with a given draw frame. The stop motion also includes a circuit for sensing and disabling a particular sliver guide position when it will not be used. A stop interface circuit connects to the draw frame's existing stop circuit wiring and stopping the draw frame.

The stop motion provides a visual identification or indication, via a light emitting diode (LED), of the particular sliver guide position where a parting of the sliver has been detected. If the stop motion is falsely triggered by an equipment failure for a particular sliver guide position, the LED indication speeds troubleshooting and repair of the stop motion.

DETAILED DESCRIPTION OF THE PREFERRED EMBODIMENT

Figure 1:
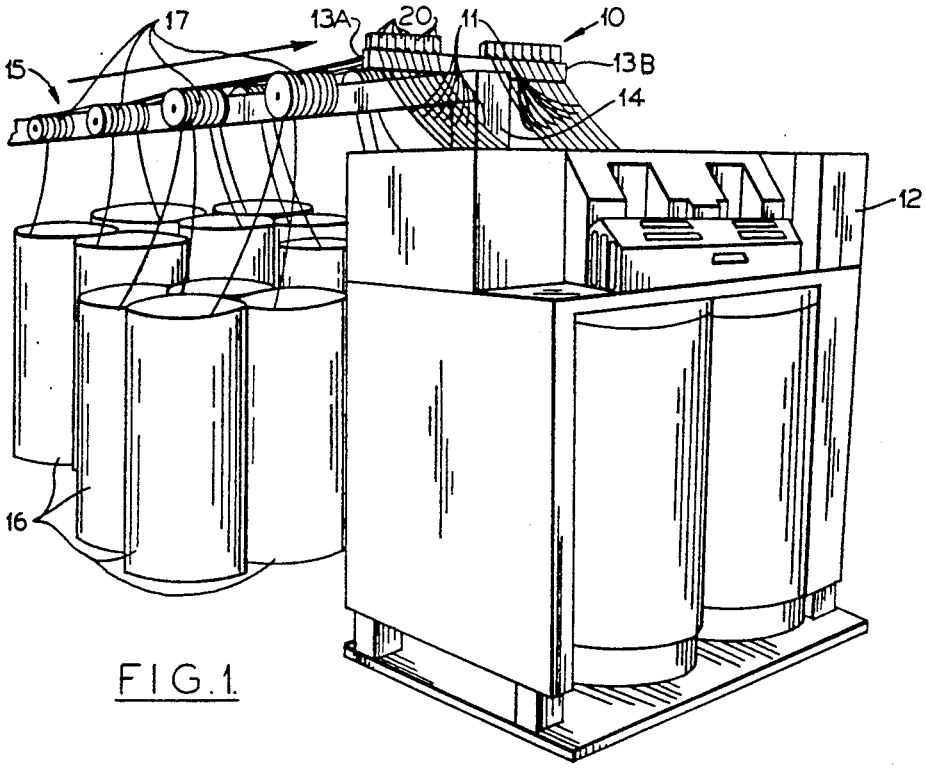
FIG. 1 is a front perspective view of the electronic stop motion according to the present invention installed on a powered creel for use in conjunction with a dual delivery textile draw frame.

Referring now more particularly to the drawings, an electronic stop motion 10 for slivers 11 fed to a dual delivery high speed draw frame 12 is illustrated in FIG. 1. The stop motion 10 consists of an elongate right and left arm 13A, 13B mounted to the center beam 14 of a powered creel 15. The slivers 11 are fed from storage cans 16 over powered rollers 17 through the sliver guides 20 of the stop motion and to the draw frame 12. The draw frame 12 has a series of roller pairs, not shown, which define a drafting zone at the rear of the draw frame. Each succeeding pair of rollers in the draw frame operates at a slightly higher speed than the prior roller pair to thereby draw the stock into a progressively narrower sliver.

Figure 2:
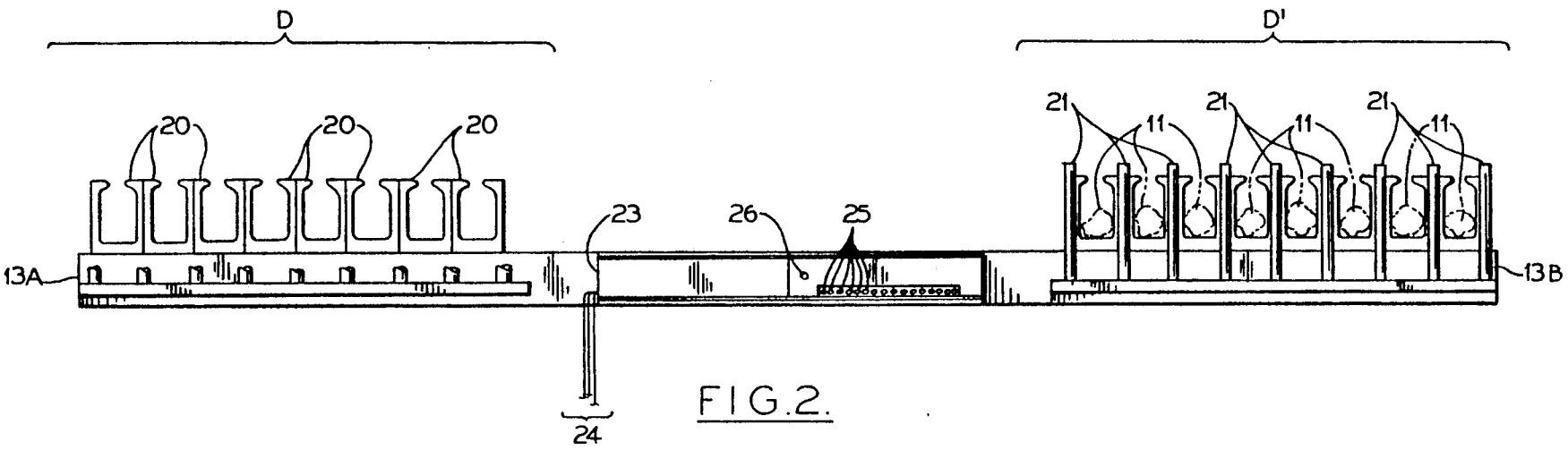
FIG. 2 is a front view of the electronic stop motion, according to the present invention, adapted for use with a dual delivery draw frame.

Referring to FIG. 2, the stop motion 10 consists of a right and left elongate arm 13A, 13B upon which a plurality of sliver guides 20 are mounted. The number of sliver guides 20 may be varied dependent upon the maximum number of slivers 11 that are delivered from the powered creel to the draw frame. A typical arrangement is sixteen sliver guides grouped into two deliveries D, D' of eight sliver guides on each end of the elongate arms 13A, 13B as shown. Thus, the stop motion 10 is a compact unit which may be readily and easily secured on a powered creel 15 (FIG. 1), especially when upgrading an existing creel and draw frame.

The slivers 11 are kept separated prior to reaching the sliver guides 20, by a series of cylindrical posts 21 positioned Out from the elongate arms 13A, 13B and aligned between the sliver guides 20. The posts 21 may be formed With a polished surface to reduce the coefficient of friction on the areas that will contact the moving sliver. As would readily be understood by those having skill in the art, a low coefficient of friction coating may alternatively be applied to the posts 21 to reduce drag on the moving slivers.

Figure 3:
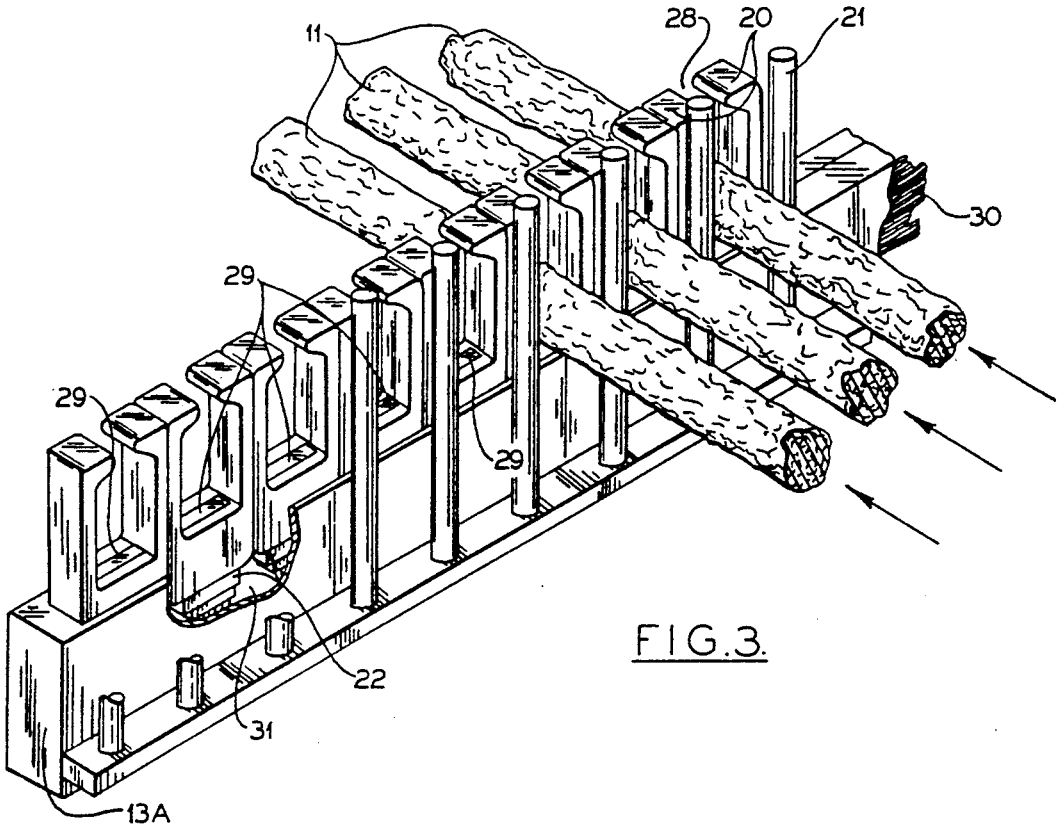
FIG. 3 is a perspective view of a portion of an elongate arm and several sliver guides according to the present invention.

The sliver guides 20 are electrically and mechanically connected to the elongate arms 13A, 13B. The sliver guides 20 are preferably formed of a nonferrous metal, such as aluminum or zinc, which assists in forming an electrical shield about the capacitive sensing switch 22 (FIG. 3). In addition, the sliver guides 20 form a shield around the individual slivers to prevent an adjacent sliver from causing a false parting indication. The elongate arms 13A, 13B are preferably tied to an electrical ground to further reduce the possibility of a false parting signal caused by stray electrical disturbances in the textile processing plant.

A housing 23 may be conveniently mounted to the elongate arms 13A, 13B. The housing 23 provides a mounting enclosure for circuit boards containing the electronic components for the stop motion. External connection wires 24 extend from the housing 23 for interconnection to: an electrical power source, the draw frame drive motor starter or clutch, and the existing stop circuit for the draw frame. The indicating lamps, preferably LED's 25, may be carried by the housing 23 so that an operator may determine the status of each sliver from one convenient location. The LED's 25 indicate the particular parted sliver by indicating the particular sliver guide 20 in the path where the parting has occurred. In addition, the housing also carries a switch 26 which allows the user to disable any sliver guides that will not be used during the drawing process as explained later in the electrical block diagram description.

In FIG. 3 is shown a detail of several sliver guides 20 and their mounting on the elongate arm 13. Each sliver guide 20 is preferably made of a nonferrous metal, such as aluminum or zinc, formed into a U-shape with inturned upper end portions of defining a restricted opening 28 at the top portion. The restricted opening 28 reduces the likelihood of a bouncing sliver from moving outside of the sliver guide 20. The sliver guide is preferably coated with a material having a low coefficient of friction to reduce the drag placed on the moving sliver 11 and to reduce the accumulation of lint on the sliver guide.

The capacitive sliver sensing switch 22 is positioned in the sliver guide 20 in the bight portion thereof. The switch 22 may be friction fit into the sliver guide 20 so that it is readily removable to facilitate repair or replacement. The capacitive switch 22 extends through the sliver guide 20 to reveal an exposed upper portion 29 which is flush with the bight portion of the sliver guide.

The capacitive sensing switch 22 operates on the principle that sliver 11 will vary electrical capacitance in the space adjacent to the sensor because of the electrical charge on the sliver. Ribbon cables 30 connect the capacitive switches 22 to the electronic circuitry contained in the housing 23 (FIG. 2) and mounted on the elongate arms 13A, 13B. The ribbon cable 30 is preferably run internally through a hollow channel 31 (FIG. 3) formed in the elongate arms 13A, 13B.

Figure 4:
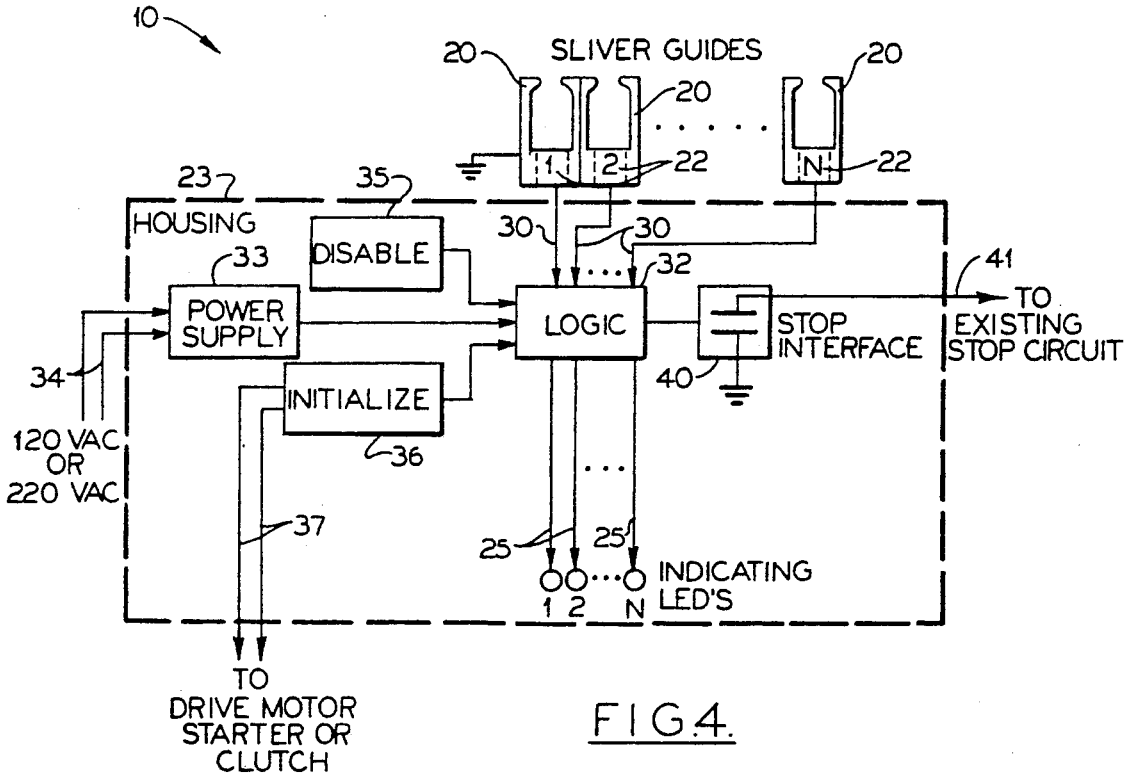
FIG. 4 is an electrical block diagram of the electronic stop motion according to the present invention.

Referring to FIG. 4, an electrical block diagram of the stop motion 10 according to the present invention is illustrated. The major electronic components of the stop motion 10 are mounted in the housing 23 carried by the elongate arms 13A, 13B (FIG. 2.) The capacitive sensing switches 22 positioned in the sliver guides 20 are connected to the logic circuit 32 via ribbon cables 30. The logic circuit 32, in combination with capacitive switches 22, functions as a capacitive detecting means for detecting the absence of a sliver or the absence of motion of a sliver in order to stop the drawing process and prevent lightweight sliver and improperly blended sliver if two or more types of fibers are present in the slivers. The logic circuit 32 preferably includes a variable common sensitivity adjustment, not shown, to compensate for different sliver speeds or materials.

The logic circuit 32, and other components of the stop motion 10, are powered by the power supply 33 which is fed by commercially available electrical power via external connections 34. The stop motion 10 also includes a sliver guide disable circuit 35 to selectively disable any capacitive sensing switch 22 in a sliver guide 20 which will not be used during a particular drawing operation as when a lesser number of slivers are to be fed. The disable feature is activated by pressing a switch 26 (FIG. 2) on the housing 23, while simultaneously depressing the draw frame start switch (not shown). The disable circuit 3$ senses the absence of slivers and disables the unused capacitive sensing switches 22 from causing the stop motion to operate during the processing operation.

The stop motion 10 circuitry includes an initialization circuit 36 which provides two functions. First, the initialization circuit 36 senses, via external connections 37, the application of electrical power to the drive motor starter or clutch of the draw frame. The initialization circuit 36 preferably has an input voltage sensing range of from 60–300 VAC or 60–200 VDC to be compatible with commonly available draw frames and powered creels. Second, a user selectable delay begins in response to sensing the start up of the motor. The delay allows the slivers to begin to move and to reach their desired operating speed. A typical delay may be from 1.2 to 10 seconds.

When a parted sliver is detected, an LED 25 is lighted by the logic circuit 32 corresponding to only the sliver guide 20 where the parting has been detected. The logic circuit 32 also sends a control command to the stop interface circuit 40 to place a momentary electrical ground on the lead 41 to the existing stop circuit of the draw frame. The momentary electrical ground is a typical stop motion interface with existing textile processing machines.

The foregoing description is to be considered illustrative rather than restrictive of the invention and those modifications which come within the meaning and range of equivalents of the claims are to be included therein.

That which is claimed is:

1. In combination with a creel and a draw frame, the draw frame having a power supply and a plurality of drafting rolls defining a drafting zone for drafting strands of textile sliver fed thereto from the creel, a stop motion for sensing a parting of the sliver prior to being fed into the drafting zone, said stop motion comprising:

at least one elongate arm mounted on the creel and upstream of the drafting zone;

a plurality of sliver guides supported by said arm in side-by-side relation thereon, said sliver guides having a low coefficient of friction to reduce accumulation of textile lint thereon, each of said sliver guides being substantially U-shaped in cross-section and having inturned upper end portions defining a restricted opining;

sliver sensing means carried by each of said U-shaped sliver guides and being positioned in a bight portion thereof and each having an exposed upper surface substantially flush with the surrounding bight portion of the sliver guide;

a series of sliver separator means supported by said elongate arm and positioned to separate strands of sliver passing through adjacent sliver guides, said separator means having a low coefficient of friction to reduce accumulation of textile lint thereon;

capacitive detecting means cooperating with said sliver sensing means for identifying the absence of any parted strand of sliver in said sliver guides and for also identifying an absence of movement of any strand of sliver in said sliver guides as when sliver is parted immediately upstream of the drafting zone; and control means responsive to said capacitive detecting means for interrupting the power supply and stopping the drafting rolls of the draw frame when the sliver is parted and responsive to means for visually identifying the particular sliver guide in the path of the parted sliver.

2. The stop motion of claim 1 wherein said elongate arm is formed of an electrically conducting material and wherein each of said plurality of sliver guides is formed of a nonferrous electrically conducting material electrically connected to said elongate arm.

3. The stop motion of claim 1 wherein each of said plurality of sliver guides has a smooth plastic coating on the surfaces adjacent o the sliver passing thereover.

4. The stop motion of claim 1 wherein said control means comprises initialization means for detecting start up of the draw frame and for not interrupting the power supply to the draw frame for a predetermined period after start up so that the slivers reach operating speed.

5. The stop motion of claim 1 wherein said capacitive detecting means comprises means for selectively disabling at least one of said sliver sensing means so that the draw frame operates with a lesser number of slivers.

6. The stop motion of claim 1 wherein said series of sliver separator means comprises a series of cylindrical posts positioned to extend upward from said elongate arm to a height at least equal to a height of an upper portion of said sliver guides, and wherein said posts have polished surfaces adjacent to the sliver passing thereover.

7. In combination with a creel and a dual delivery draw frame, the draw frame having a power supply and a plurality of drafting rolls defining a drafting zone for drafting strands of textile sliver fed thereto from the creel, a stop motion for sensing a parting of the sliver prior to being fed into the drafting zone, said stop motion comprising:

a pair of elongate arms mounted on the creel behind the drafting zone;

a plurality of sliver guides supported by each of said arms in side-byside relation thereon, said sliver guides being grouped on each of said arms corresponding to a delivery of slivers, said sliver guides having a low coefficient of friction to reduce accumulation of textile lint thereon, each of said sliver guides being substantially U-shaped in cross-section and having inturned upper end portions defining a restricted opening;

sliver sensing means supported by each of said U-shaped sliver guides in each group and being positioned in a bight portion of the sliver guide and each having an exposed upper surface substantially flush with the surrounding bight portion of the sliver guide;

a series of sliver separator means carried by each of said elongate arms and positioned to separate strands of sliver passing through adjacent sliver guides, said separator means having a low coefficient of friction to reduce accumulation of textile lint thereon;

capacitive detecting means cooperating with said sliver sensing means for identifying an absence of any parted strand of sliver in said sliver guide and for also identifying the absence of movement of any strand of sliver in said sliver guides as when sliver is parted immediately upstream of the drafting zone;

control means responsive to said capacitive detecting means for interrupting the power supply and stopping the drafting rolls of the draw frame when the sliver is parted and responsive to means for visually identifying the particular sliver guide in the path of the parted sliver; and a rectangularly shaped housing carried by at least one of said elongate arms, said capacitive detecting means and said control means contained within said housing.

8. The stop motion of claim 7 wherein said capacitive detecting means comprises connecting means for electrically connecting the sliver sensing means and the capacitive detecting means, wherein each of said elongate arms comprises a hollow rectangularly shaped body having an open channel therein, and wherein said electrical connecting means is substantially contained within said open channel.

9. The sop motion of claim 7 wherein each of said elongate arms is formed of an electrically conducting material and wherein each of said plurality of sliver guides is formed of a nonferrous electrically conducting material electrically connected to said elongate arms.

10. The stop motion of claim 7 wherein each of said plurality of sliver guides has a smooth plastic coating on the surfaces adjacent to the sliver passing thereover.

11. The stop motion of claim 7 wherein said control means comprises initialization means for detecting start up of the draw frame for a predetermined period after start up so that the slivers reach operating speed.

12. The stop motion of claim 7 wherein said capacitive detecting means comprises means for selectively disabling at least one of said sliver sensing means in each of said groups so that the draw frame operates with a lesser number of slivers in each group.

13. The stop motion of claim 7 wherein said series of sliver separator means comprises a series of cylindrical posts positioned to extend upward from said elongate arms to a height at least equal to a height of an upper portion of said sliver guides, and wherein said posts have a polished surface adjacent to the sliver passing thereover.

* * * * *

UNITED STATES PATENT AND TRADEMARK OFFICE

CERTIFICATE OF CORRECTION

PATENT NO. :5,086,542

DATED :February 11, 1992

INVENTOR(S) :James R. Franklin et al.

It is certified that error appears in the above-identified patent and that said Letters Patent is hereby corrected as shown below:

Column 6;

Claim 3, line 49 "o" should be --to--.

Column 6;

Claim 7, line 8 "side-byside" should be --side-by-side--.

Signed and Sealed this

Fourth Day of May, 1993

*Attest:*

Michael K. Kirk

MICHAEL K. KIRK

*Attesting Officer*

*Acting Commissioner of Patents and Trademarks*